United States Patent [19]

Mueller

[11] Patent Number: 5,050,812

[45] Date of Patent: Sep. 24, 1991

[54] DUAL-ENVELOPE MAKING MACHINE AND METHOD OF USING

[75] Inventor: Henry H. J. Mueller, Wrentham, Mass.

[73] Assignee: Sterling Envelope Corporation, Tauton, Mass.

[21] Appl. No.: 622,476

[22] Filed: Dec. 5, 1990

[51] Int. Cl.[5] ..... B65H 19/18; B65H 23/188; B65H 23/16

[52] U.S. Cl. ..... 242/58.1; 226/36; 226/119

[58] Field of Search ..... 242/58.1; 226/36, 118, 226/119

[56] References Cited

U.S. PATENT DOCUMENTS

| | | | |
|---|---|---|---|
| 2,314,070 | 3/1943 | Bogoslowsky | 226/36 X |
| 2,491,228 | 12/1949 | Swift | 226/36 |
| 3,371,834 | 3/1968 | Willits et al. | 226/36 X |
| 3,794,231 | 2/1974 | Martin | 226/36 |
| 3,836,089 | 9/1974 | Riemersma | 242/58.1 |
| 3,841,545 | 10/1974 | Gingher, Jr. | 226/36 |
| 4,856,692 | 8/1989 | Harper | 226/119 |

*Primary Examiner*—John M. Jillions
*Attorney, Agent, or Firm*—Cushman, Darby & Cushman

[57] ABSTRACT

An envelope machine which makes two envelopes at once. One web is used up to a relatively advanced point in the envelope forming process to simultaneously form two envelopes. At a terminal portion of the envelope processing, the web is cut lengthwise to form two envelopes. The device also includes improved structure for maintaining uniform the tension on the web. This need for uniform tension is made more prevalent by the thickness of the web which must be used to form two envelopes in parallel. The structure of the present invention which maintains uniform the thickness of the web is formed herein by a dancer roll which moves in a longitudinal fashion in cooperation with movement of other associated rolls. Whenever the dancer roll reaches one of its stopping points, it sets off a limit switch which operates a piston to change the type of moving being applied to the dancer rolls. A dual paper roll system is also used so that when one of the paper rolls is used as the primary roll, the other paper roll is put into place as a backup roll.

5 Claims, 4 Drawing Sheets

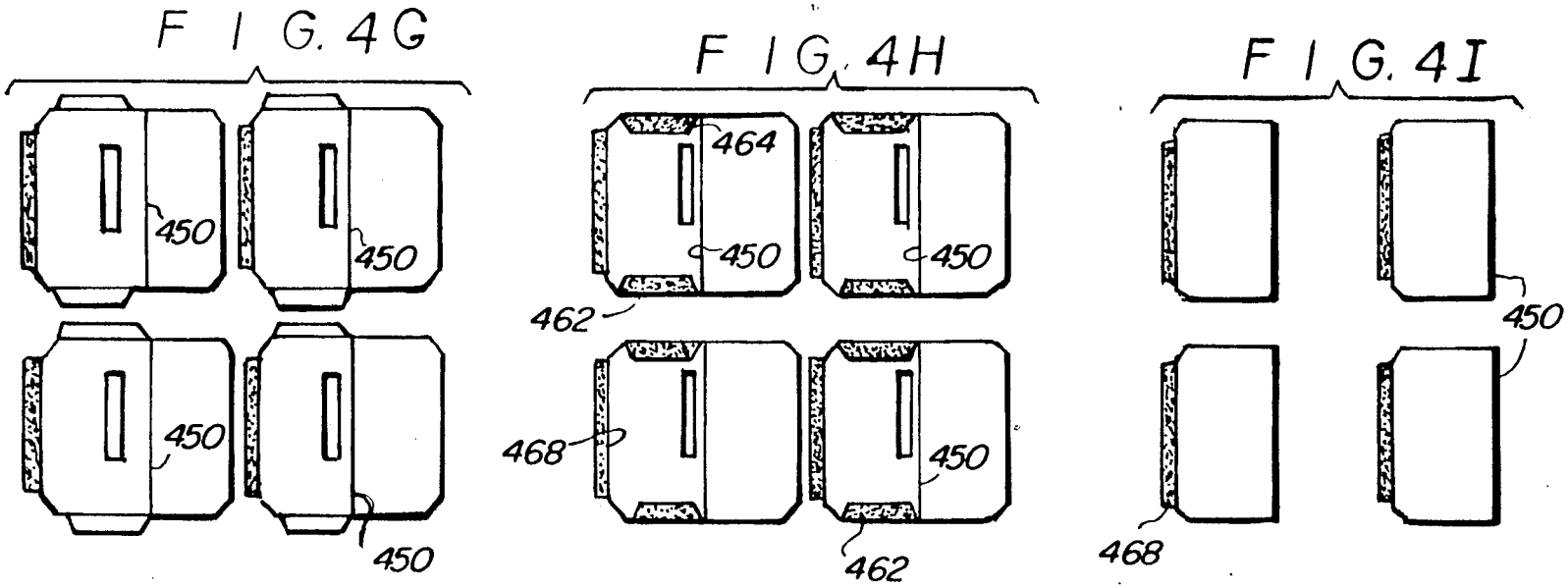
FIG. 4G
FIG. 4H
FIG. 4I
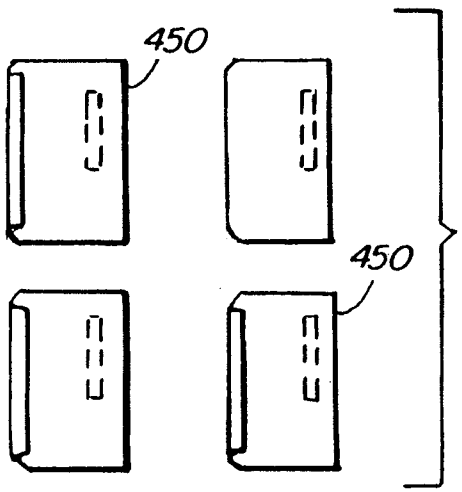
FIG. 4J

DUAL-ENVELOPE MAKING MACHINE AND METHOD OF USING

BACKGROUND OF THE INVENTION

The present invention relates to a method and apparatus for making two envelopes at once. The device further includes improved methods for dealing with the associated problems with such a machine.

BACKGROUND OF THE INVENTION

At one time all envelopes were made by hand, by cutting envelopes to size and gluing them together. The advent of mechanization of many other processes also brought about the mechanization of the envelope making process. It is almost unheard of to see a hand-folded envelope these days. Most envelopes are made in mass production, on an envelope making machine, which performs all of the envelope functions including paper cutting, folding and gluing. This has made it possible to make envelopes at a relatively high speed, although higher speed is always desirable.

At the present time, state of the art envelope-making machines have a top speed of about 1,000 envelopes per minute. These envelope makers make one envelope at a time, and the end product can be of only one type. In order to make a different type envelope, the machine must be turned off, and reconfigured in some way.

It is an object of the present invention to at least double this possible speed available from a current envelope maker. It is also an object of the present invention to provide a machine which can simultaneously make more than one envelope at a time.

One of the big problems in making envelopes is the turn-around time for an order. The turn-around time for an order may be exacerbated if machines must be frequently taken down in order to reconfigure the machine. The necessity to frequently reconfigure these machines greatly decreases their efficiency.

Therefore, it is an object of this invention to make a machine which does not need to be configured as frequently.

Another problem of automated enveloped machines is the problem of tension on the "web". The envelopes are cut from a continuous roll of paper which is known in the art as a web. The tension on the web must be evenly maintained, or else wrinkles will form which could jam the machine, or at best form a low quality final product. The problems of tension on the web become exacerbated as the web gets wider. It is an object of the present invention to provide an improved technique of maintaining the tension on the web, even when the web is very wide.

Finally, another operation which is very time consuming is when the envelope machine runs out of paper. At this time, it becomes necessary to change the envelope machine roll. It is an object of the present invention to somewhat ameliorate these problems.

Various techniques have been used in the prior art to attempt to deal with these and other problems in envelope making machines. One such technique is U.S. Pat. No. 4,531,993 to Bradley. The disclosure of this patent is hereby incorporated by reference to the degree deemed necessary. Bradley shows, in FIGS. 1–11, the steps of folding a cut sheet of paper into an envelope. The Bradley envelope is a double folded type envelope, but shows the basic features of envelope folding. However, the problem with Bradley is the same as that of the prior art. Specifically, the Bradley technique could only accommodate one envelope at a time, and therefore would have to be reconfigured for each new kind of envelope. Moreover, this device is subject to the speed limitations of the prior art.

U.S. Pat. No. 3,565,728 defines a method and apparatus for forming a continuous assembly of articles, and apparently could be used for assembling devices like envelopes. However, there is no provision in Alton for forming more than one envelope at a time, nor of the structure of the present invention for maintaining a uniform tension on the web.

Finally, U.S. Pat. No. 1,503,155 to Haas shows an envelope making machine, but again, this has all the drawbacks of the prior art.

SUMMARY OF THE INVENTION

In order to overcome these problems, the present invention proposes a method and apparatus which overcomes all of these problems. The envelope machine of the present invention forms two envelopes simultaneously. The present invention therefore enables the one web to be used up to a relatively advanced point in the envelope forming process to simultaneously form two envelopes. Therefore, all of the web feeding structure need not be duplicated. This one set of web feeding structure feeds the web through a variety of envelope-making functions.

At a terminal portion of the operation, the web is cut lengthwise to form two envelopes. These two envelopes need not be of the same size, and therefore two envelopes, which can be of varied sizes, are simultaneously produced by the structure.

As stated above, one great advantage of this machine is that it doubles the output of currently available technology. This is because two envelopes are made at once. Since these envelopes need not be of the same type, two different runs of envelopes can be simultaneously made without stopping the machine to change envelope characteristics.

The device of the present invention also includes improved structure for maintaining uniform the tension on the web. This need for uniform tension is made more prevalent by the thickness of the web which must be used to form two envelopes in parallel. The structure of the present invention which maintains uniform the thickness of the web is formed herein by a dancer roll which moves in a longitudinal fashion in cooperation with movement of other associated rolls. Whenever the dancer roll reaches one of its stopping points, it sets off a limit switch which operates a piston to change the direction of movement being applied to the dancer rolls.

Finally, the present invention uses a dual paper roll system. One of the paper rolls is used as the primary roll, while the other paper roll is put into place as a backup roll. When the first roll is exhausted, the second roll immediately comes into action, thereby minimizing the down time of the resultant system.

BRIEF DESCRIPTION OF THE DRAWINGS

These and other objects of the present invention will now be described in detail with reference to the accompanying drawings, where:

FIGS. 4A–4J show the envelope in its various stages of processing.

DETAILED DESCRIPTION OF THE PREFERRED EMBODIMENT

A presently preferred embodiment of the invention will now be described with reference to the accompanying FIGUREs.

Figure 1:
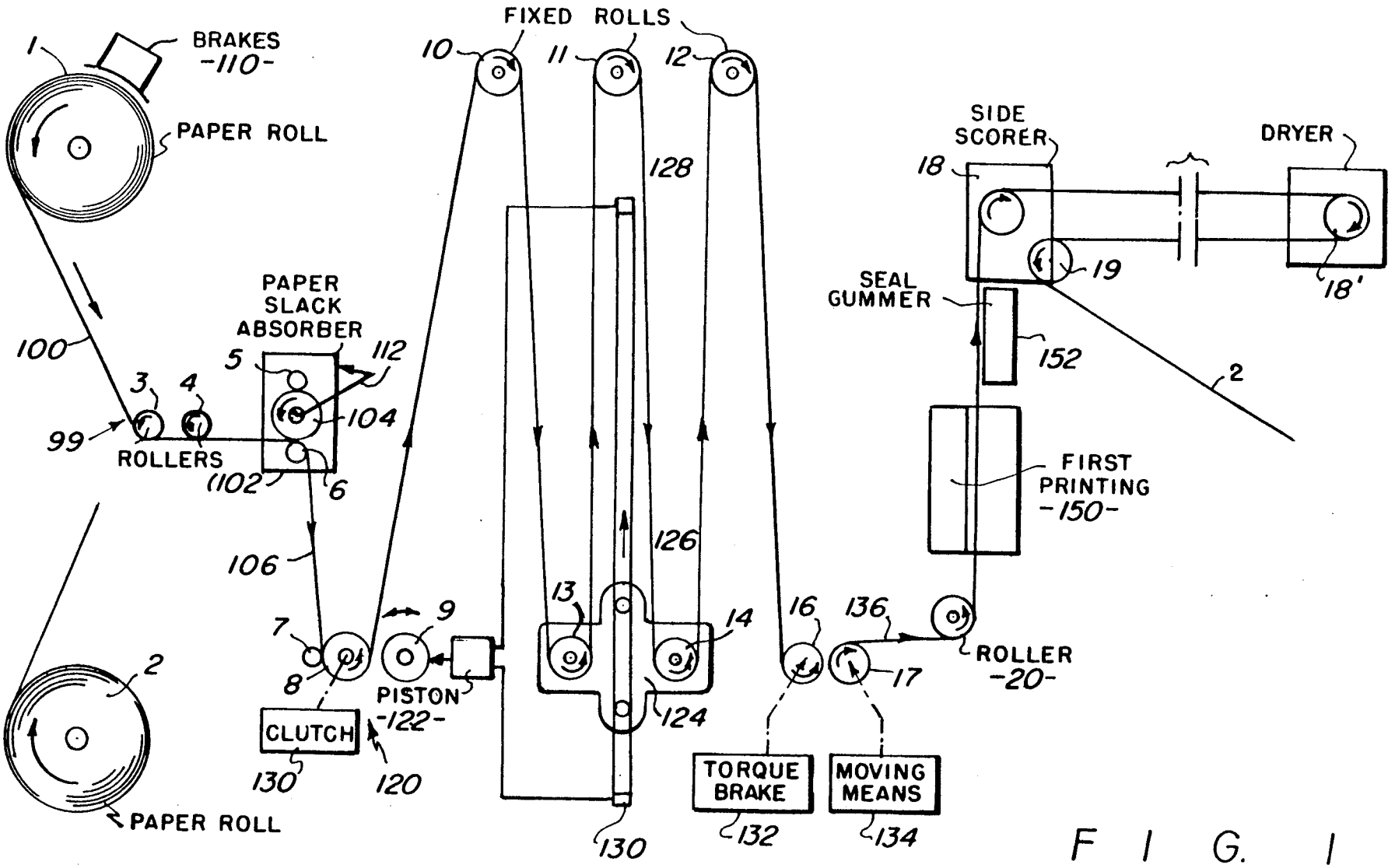
FIGS. 1–3 show a schematic diagram of the flow of the envelope making machine of the present invention, FIG. 1 showing a first part, FIG. 2 showing a second part, and FIG. 3 showing a terminal part of the paper processing.
Figure 2:
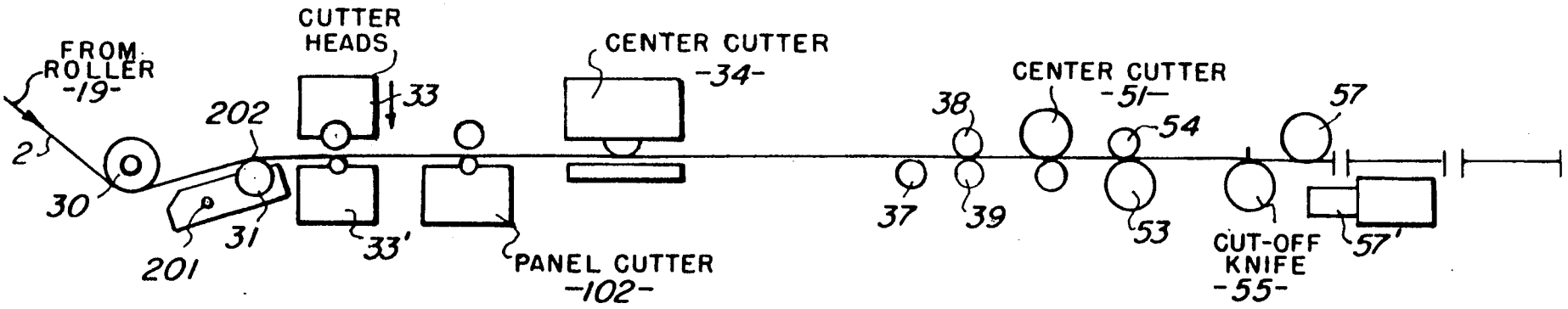
Figure 3:
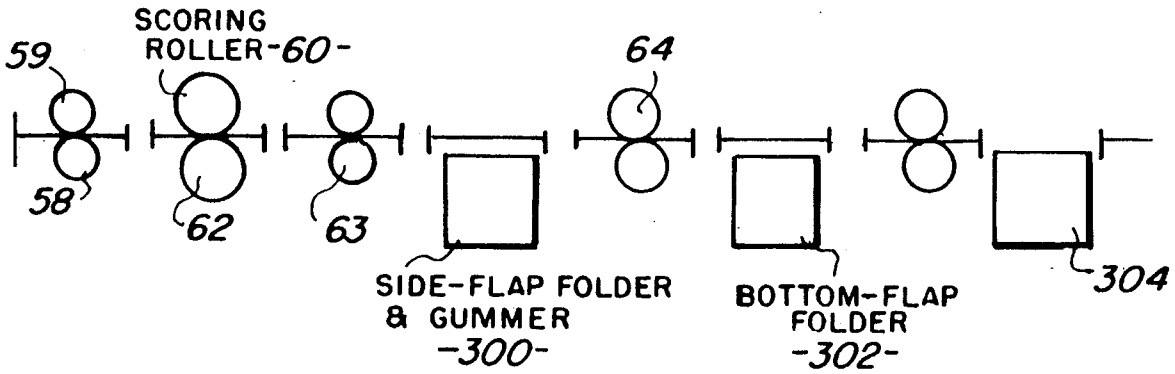

FIGS. 1–3 show a schematic block diagram of the envelope machine of the present invention, including showing the paper path thereof. The terminology used throughout the specification and claims is that the path of the paper flows downstream, and that the paper roll is upstream of all other processing structure.

FIG. 1 shows the beginning portion of the paper roll processing. Two paper rolls, 1 and 2 are provided. Paper roll number 1 is the operational paper roll, while number 2 is the standby. In operation, paper 100 unrolls from paper roller 1, in the direction shown by the arrow. The paper passes over rollers 3 and 4 which are guiding rollers, to paper slack absorber assembly 102. Paper slack absorber 102 includes rollers 5 and 6. These rollers are biased to rotate around the spring loaded center axis 104, to keep a uniform tension on the paper. The paper exits at the location shown by arrow 106.

In operation, paper normally unwinds from paper roll 1 until paper roll 1 is exhausted. At this time, the apparatus is quickly stopped, and the paper from paper roll 2 is spliced into the end of the paper from paper roll 1 at location 99. This is a very quick process, and should take less than a minute. The machine is then turned back on, and operation can continue as normal with only a minimal interruption.

Rollers 5 and 6 normally rotate about a spring loaded center axis 104. When the machine is stopped, a brake 110 operates to stop the paper roller 1 from unrolling excessive amounts of paper. This could cause excessive slack in the system which could lead to a paper jam. However, what may happen is that the brake 110 on paper roller 1 may be slower than the brake of the machine. As the machine starts up again, the spring 112 would then be overpowered by the tension of the paper, and will pull roller 6 against roller 104 until it comes to a rest position as shown in the drawings. Therefore, the assembly 102 effectively serves to prevent slack in the paper from causing any problems in the system.

Paper at location 106 is then routed to tension maintaining assembly 120. Tension maintaining assembly 120 includes a pressure roller 7, pull roller 8, and another pull roller 9, which is movable in the direction of the arrow shown near roller 9. Roller number 8 is somewhat smaller in diameter than roller number 9 (in this embodiment 0.020 inches smaller). In operation, paper is biased between rollers 7 and 8, and when the machine starts up, these rollers pull the paper off the paper roll 1 with roller 9 being disengaged as shown in FIG. 1. The position of roller 9 is itself controlled by piston 122, so that its position can selectively be in and out of engagement with roller 8.

The paper being fed by rollers 7/8 is then sent to fixed roller 10, routed around fixed roller 10 to moveable roller 13 which is mounted on carriage 124 along with moveable roller 14. The paper around roller 13 is routed to fixed roller 11, back to movable roller 14 which is also mounted on the carriage 124 with roller 13 and therefore moves up and down therewith, and finally to fixed roller 12. The paper out from roller 12 has been equalized in tension.

In operation, roller 8 is sized such that when it operates, less paper fed into the machine than that optimal for operation of dancer rollers 13 and 14 to maintain them in position. This causes dancer rollers 13 and 14 and the associated carriage 124 to gradually move upward, in the direction of arrow 126 shown in FIG. 1. These roller assemblies move upward until reaching the limit point at which upper limit switch 128 is located. Upper limit switch 128 controls piston 122, and actuation of upper limit switch 128 by the dancer assembly 124 actuates piston 122 to adjust the position of roller 9, to engage roller 9 against roller 8. Roller 9, which is a larger roller, thus becomes an overfeeding pull roll.

Roller 8 is also controlled by an overrunning clutch bearing 130, and when roller 9 comes into place, this clutch bearing allows roller 8 to run at the speed set by roller 9. Since roller 9 is larger than roller 8 and overfeeding, this causes the dancer assembly 13/14/124 to move downward. Downward movement continues until lower limit switch 130 is reached, at which time piston 122 and clutch 130 are deactivated, causing roller 8 to once again take over as the pull roller. This starts the cycle over again, wherein the dancer assembly 13/14/124 begins its upward movement.

This mechanism keeps an evenly constant tension on the web traveling towards the printers and the remaining parts of the machine without the need to have some costly electric tensioning controls. The weight of dancer assembly 13/14/124 acts as the actual tension control. The operations performed between rollers 5/6, 7, 8 and 9 operate to maximize the constant tension of the invention.

The paper web fed from fixed roller 12 is therefore equalized in tension. This paper is fed downstream towards an additional tension controller formed by rollers 16 and 17 to maintain an absolute even tension on the web. Roller 16 is associated with torque brake 132 which applies a magnetic torque brake to roller 16. Roller 17 is a moveable roller, and has a moving means 134 associated therewith. Appropriate control of torque brake 132 and moving means 134 can be effected to set any desired drag on the rollers 16 and 17.

The paper at point 136 is fed to a permanent roller 20, and the envelope processing begins at that point.

One advantage of the present invention is that all structure upstream of roller 20 maintains the proper tension on the web. This structure does so in a new and advantageous way. The web itself makes two envelopes as shown herein. The structure also enables duplicate paper rolls to be used so that when one paper roll is exhausted, the other one can quickly be spliced thereon. The remaining structure of the present invention processes the web to form two envelopes in parallel. This is advantageous over two separate envelope machines, as two separate envelope machines would have to duplicate the tension maintaining structure upstream of element 20. In contrast, the present invention operates to form two envelopes simultaneously using one set of tension maintaining structure.

The paper from roller 20 is coupled to the first set of printing heads 150, and then to the seal gummer 152. The paper coming from seal gummer 152 has been coated with gum in the location where the envelope will have its final sealing location.

Figure 4A:
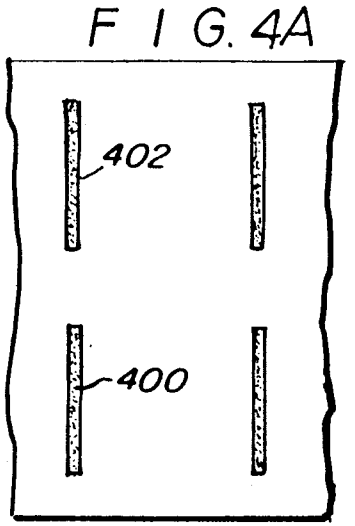

FIG. 4A shows a section of paper web 100 which has been processed and exited from seal roller gummer 152.

Seal gummer 152 prints two strips of gum 400 and 402 on the web at distances corresponding to where adjacent envelopes will be formed. These strips are printed on the web 100 at every predetermined interval of distance, and eventually become the flap of the envelope.

Figure 4B:
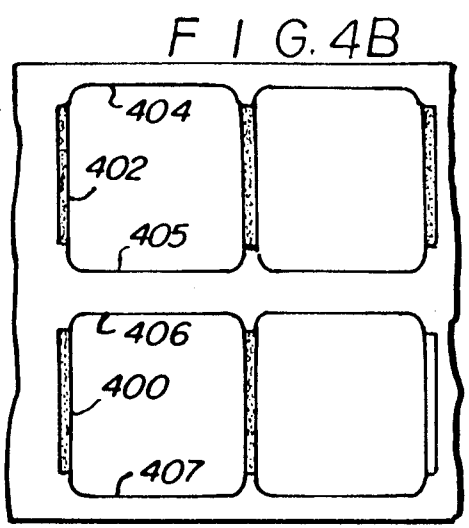

From the seal gummer 152, the web passes to side scorer 18, which places scores in the sides of the web at positions corresponding to where the envelope sides will be folded inward. These scores are shown in FIG. 4B as scores 404, 405, 406 and 407.

Roller 18 is made with a hard rubber coating place four score lines 404, 405, 406 and 407 into the web. This score is used to help fold over the side flaps more easily.

The paper web 100 then travels to dryer roller 18', and finally back to dryer interface roller 19. The distance between side scorer 18 and dryer roller 18' is chosen to be long enough so that the gum imprinted by seal gummer 152 will dry by the time the web returns to roller 19.

The web then passes from roller 19 to roller 30 which begins the processing shown on FIG. 2.

Roller 30 is a fixed paper roll which receives the paper web, and changes its direction. The paper passes over roller 30, to adjustable roller 31. Adjustable roller 31 is adjustable to pivot around its center axis 201, to adjust the position of the paper web at this point labeled 202. The position of this paper web must be adjusted in order to allow the paper web to fit tightly against cutter heads 33.

Figure 4C:
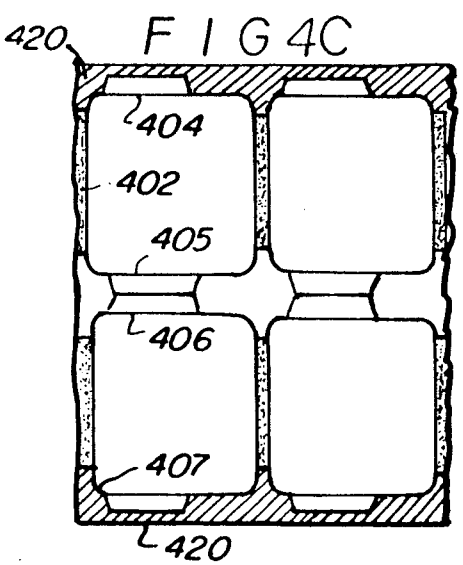

Cutter heads 33 and 33' are located opposite each other, and are used to shape the side flap configuration. Cutter heads 33 and 33' cut out a side flap area as shown hatched and labeled as area 420 in FIG. 4C.

The paper web then passes further down the line to panel cutter 102. This is optional, and is only operated when envelopes of the panel type are desired. The envelopes with panels cut are shown from FIG. 4D onward in order to help visualize the location of the envelope, although such panel cutting is optional.

Figure 4D:
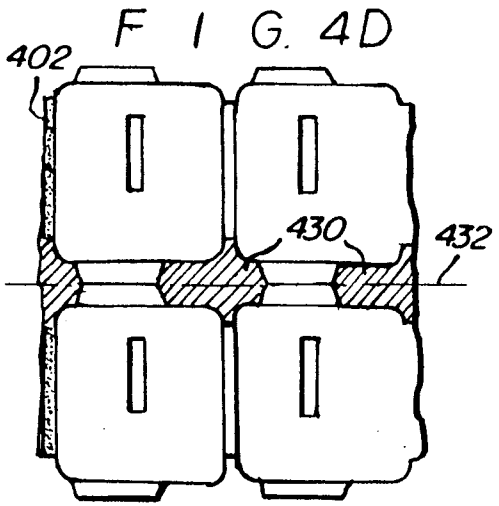

Panel cutter 102 is followed by center cutter 34 which cuts out further areas of this portion of the web, forming side flap configurations of side by side envelopes as shown in FIG. 4D. FIG. 4D shows the paper web which has now been cut for folding and scored at its outside edges. Center cutter 34 cuts out the hatched portion 430 in FIG. 4D. Therefore, the cutting done by cutter head 34 forms two side-by-side envelopes which are still attached. These envelopes have been scored for folding along lines 404, 405, 406 and 407 by roller 18.

The web then passes to fixed roller 37, and to second pull rollers 38/39. Rollers 38/39 operate to pull the paper out of the dancer roller assembly 13/14 which was discussed above. This enables an even tension through all of the prior operations including printing the seal gum application, side scoring, outside side flap cutters, and center side flap cutters as well as the window cutter. The operation downstream of second pull rollers 38/39 operates under a different tension for reasons which will become more apparent herein.

Figure 4E:
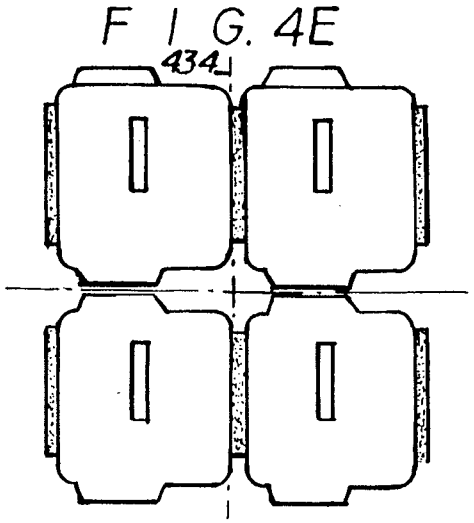

The web then passes to center knife shear 51 which is a rolling knife blade which separates the two envelope bodies from one another to produce a configuration as shown in FIG. 4E. FIG. 4E shows the two envelope bodies having been separated from one another. The space between these two envelope bodies is, of course, exaggerated, in order to show that the envelope bodies have been separated from one another along center line 432. While center shear 51 is shown and described as cutting the center of the web, it should be understood that the spot where it cuts need not be the center. If two envelopes of different size are formed, the location of cutting may be, for instance, a third of the way across the web. More generally, center shear 51 is a longitudinal cutter, and separates the web longitudinally.

Figure 4F:
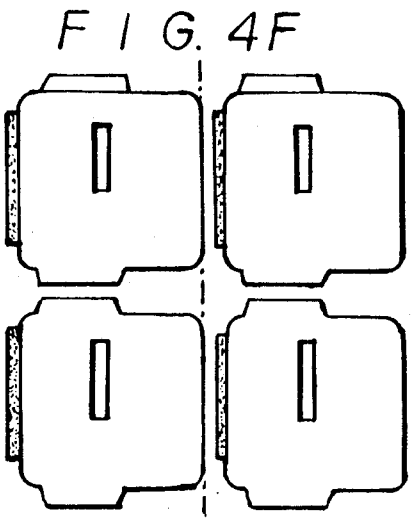

Feed rollers 53 and 54 feed the separated web comprising two separate envelope bodies to separating/cut off knife 55. Cut off knife 55 separates the envelope bodies one from another, and therefore from the web, so that after rollers 53/54, there is no longer a continuous web. FIG. 4F shows the configuration of the envelopes after they have been sliced by cut off knife 55. The envelopes have been cut along the line 434 in FIG. 4E.

Since cut off knife 55 cuts the web, all operations downstream of this point take place on a discontinuous web. This is represented in FIG. 2 by showing discontinuous parts of the web which represent the cut envelope portions. Pull out segment 57 is provided and bias against surface 57', and operates to pull out each portion of the web after having been cut by the cut off knife 55.

The further processing of the web is illustrated on FIG. 3. Blank transfer rollers 58 and 59 receive the discontinuous elements of the paper web, and transfer these elements towards scoring roller 60. Scoring roller 60 is a scoring roller rubbing against a rubber coated roller 62. As the paper travels between the two rollers, two cross knives penetrate into the rubber creating a score on each envelope segment passing therethrough. The scored envelopes produce the scoring lines 450 as shown in FIG. 4G.

The scored envelopes then pass to a further feeding roller 63 which feeds the envelopes first to a side flap folding section 300 to produce the envelopes as shown in FIG. 4H. Strips of glue 460, 462 and 464 are deposited on each of the locations shown. This is most advantageously done using a cold glue spraying device which applies a strip of glue on each of the four side flaps. The thus processed envelopes are then passed by rollers 6 to the bottom flap folder section 302 which folds the envelopes along the score line 450 to produce the envelope shown in FIG. 4I. In operation, the bottom flap folder 302 includes a roller which has vacuum ports to lift the leading edge of the blank upward between two rollers. When the bottom scorer of the blank lines is slightly ahead of the suction ports, the bottom of the envelope is fed into belt transfer section rollers which transfer the envelopes further down the line. A final folding assembly 304 folds the top flap as shown in FIG. 4J to produce a plurality, a finished product envelopes.

Although only a few embodiments have been described in detail above, those of ordinary skill in the art will certainly recognize that many modifications are possible without departing from the teachings of the present invention. All such modifications are intended to be encompassed herein.

What is claimed is:

1. A system for maintaining uniform a tension on a flat sheet, comprising:

a first small roller;

a second roller, larger than said first roller, and engaged against said first roller, and adapted to receive said flat sheet passing between said second roller and said first small roller;

at least one fixed roller, disposed downstream of said first and second rollers, so that said sheet passes from between said first and second rollers to said fixed roller;

a dancer roller assembly, formed to be movable relative to said fixed roller, to move toward said fixed roller and away from said fixed roller;

upper and lower limit switches, mounted adjacent said dancer roller assembly, and actuated by said dancer roller assembly approaching a position of said limit switches;

a third roller larger than said second roller, and movable to be selectively biased against said second roller, said second roller underfeeding said paper such that said dancer assembly moves in a first direction as a response to said underfeeding, and said third roller overfeeding said paper assembly such that said dancer assembly moves in a second direction opposite to said first direction; and controlling means, responsive to said first and second limit switches, for selectively actuating said third roller to bias against said second roller to reverse a direction of movement of said dancer roller assembly, based on actuations of said limit switches indicative of said dancer roller reaching limits of its travel.

2. A system as in claim 1 wherein said dancer assembly is located vertically to move upward and downward, such that the weight of said dancer assembly operates to maintain the tension in the system.

3. A system as in claim 2 wherein said second roller is sized such that less paper is fed into the dancer assembly than optimal, to cause the dancer assembly to move upwards, and wherein said upper limit switch operates said piston to cause a third roller to be biased against said second roller, to feed more paper than optimal thus causing said dancer assembly to move downward.

4. A system as in claim 3 wherein said lower limit switch causes said third roller to be disengaged.

5. A machine as in claim 1 further comprising said paper sheet feeding which means includes two paper rolls, and means for splicing a beginning of one roll onto an end of the other.

* * * * *